United States Patent [19]

Nishimoto

[11] Patent Number: 4,471,681

[45] Date of Patent: Sep. 18, 1984

[54] ELECTRONIC MUSICAL INSTRUMENT CAPABLE OF PRODUCING A MUSICAL TONE BY VARYING TONE COLOR WITH TIME

[75] Inventor: Tetsuo Nishimoto, Shizuoka, Japan

[73] Assignee: Nippon Gakki Seizo Kabushiki Kaisha, Hamamatsu, Japan

[21] Appl. No.: 422,518

[22] Filed: Sep. 23, 1982

[30] Foreign Application Priority Data

Oct. 1, 1981 [JP] Japan ..... 56-156923

[51] Int. Cl.[3] ..... G10H 1/06

[52] U.S. Cl. ..... 84/1.23; 84/1.01

[58] Field of Search ..... 84/1.19, 1.22, 1.23, 84/1.24, 1.01

[56] References Cited

U.S. PATENT DOCUMENTS 4,270,430 6/1981 Deutsch ..... 84/1.23

*Primary Examiner*—Forester W. Isen

*Attorney, Agent, or Firm*—Remy J. VanOphem

[57] ABSTRACT

Each one of a plurality of harmonic components is multiplied with a first amplitude coefficient to form a plurality of harmonic components corresponding to a musical tone signal having a desired waveform. Each of the harmonic components is varied with time by a first envelope waveform signal in accordance with a second amplitude coefficient corresponding to each harmonic to form a harmonic component of a spectrum varying with time in a desired manner. By using a second envelope waveform signal, amplitudes of respective harmonic components are varied in a predetermined manner and then the harmonic components are synthesized to form a musical tone.

7 Claims, 10 Drawing Figures

ELECTRONIC MUSICAL INSTRUMENT CAPABLE OF PRODUCING A MUSICAL TONE BY VARYING TONE COLOR WITH TIME

BACKGROUND OF THE INVENTION

This invention relates to an electronic musical instrument of the harmonic synthesizing type capable of freely and greatly varying with time the tone color of a musical tone.

An electronic musical instrument such as a music synthesizer or the like has been used by many performers because the tone color of the musical tone generated by the musical instrument can be freely and greatly varied with time.

However, since such an electronic musical instrument is constructed of analog elements (e.g. circuit parts exhibiting values determining circuit operation for analog signal processing), it is necessary to design the musical instrument by taking into consideration the temperature characteristic as well as the aging characteristic which makes it difficult to insure a definite and long-term reliability. Moreover, as it is difficult to fabricate the analog elements into an integrated circuit, the size of the instrument becomes relatively large.

SUMMARY OF THE INVENTION

Accordingly, it is an object of this invention to provide an electronic musical instrument that can be readily designed and can vary freely and greatly with time the tone color of the musical tone yet be of simple construction.

Briefly stated, according to this invention, a plurality of original harmonic components (of a flat spectrum) are first produced as an initial signal and each of the harmonic components is multiplied with each corresponding one of a first set of amplitude coefficients to form a plurality of tone-colored harmonic components constituting a musical tone signal having a desired waveform (frequency spectrum). Each of the harmonic components is multiplied with each corresponding one of a second set of amplitude coefficients which are, respectively, given time variations by a first envelope waveform signal to provide harmonic components in a spectrum which varies as a function of time.

A second envelope waveform signal is multiplied to the above-provided harmonic components as a whole to impart a general envelope to the tone signal varying in a predetermined manner and then the harmonic components are synthesized to form a musical tone signal.

In accordance with this invention, there is provided an electronic musical instrument having harmonic generating means for generating a plurality of original harmonic components, amplitude coefficient generating means for generating a first set of amplitude coefficients for the respective harmonic components and a second set of amplitude coefficients for respective harmonic components, time function generating means for generating a first time function signal and a second time function signal, each of which varies with time in a predetermined manner, first computing means for producing respectively coefficients varied, as a function of time, for the respective harmonic components by arithmetically combining each amplitude coefficient of the second set of amplitude coefficients with the first time function signal, second computing means for producing modified harmonic components varied, as a function of time, by arithmetically combining each of the original harmonic components with the corresponding one of the first set of amplitude coefficients, the corresponding one of the coefficients varied, as a function of time, and the second time function signal, and synthesizing means for synthesizing the modified harmonic components, thereby producing a musical tone.

Figure 1:
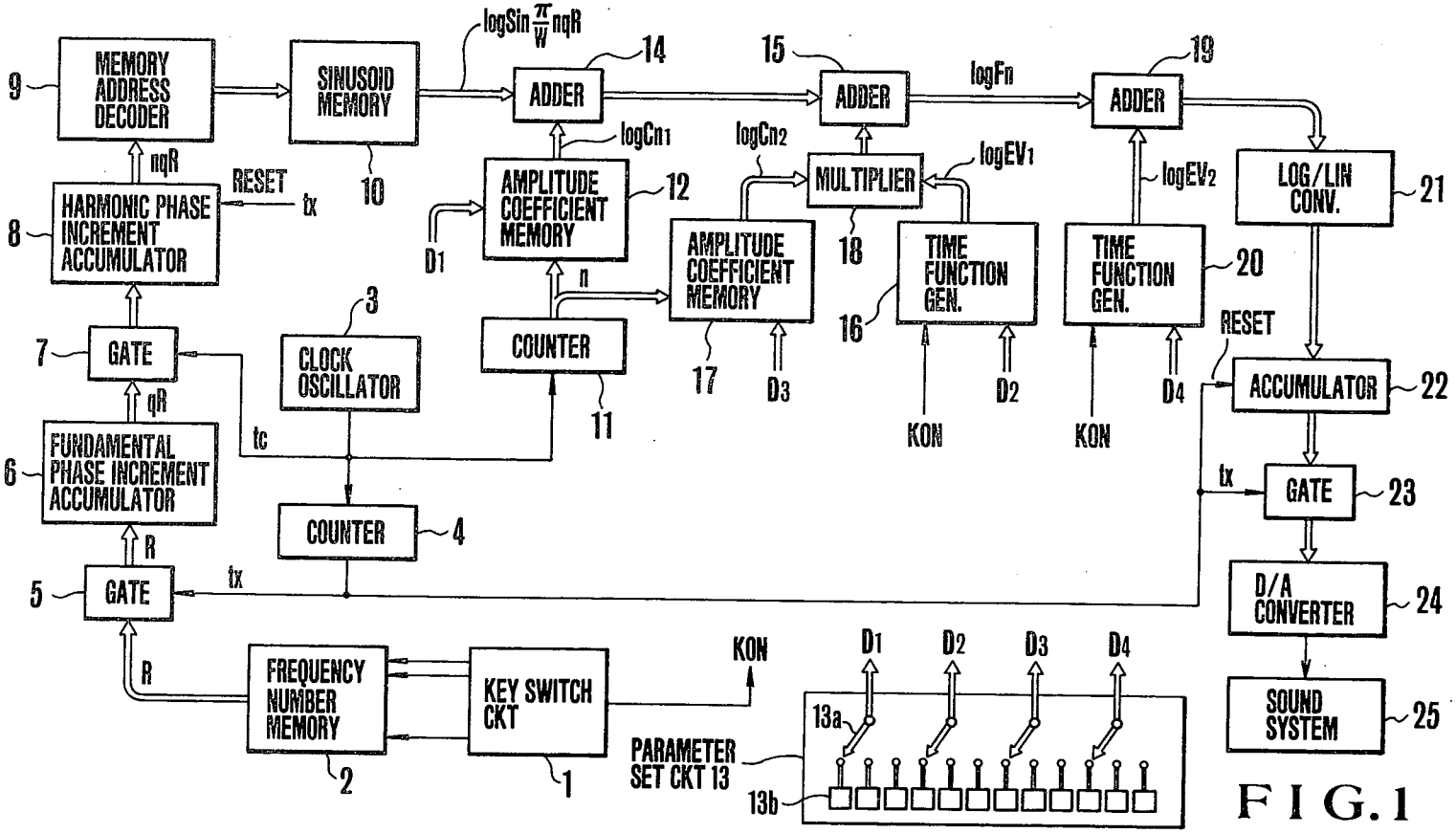
FIG. 1 is a block diagram showing one embodiment of this invention.

FIGS. *2a*, *2b* and *2d* are spectrum charts showing amplitudes of or coefficients for harmonic components at respective points in the circuit shown in FIG. 1; and FIGS. *2c* and *2e* through *2i* are waveform charts showing waveforms of signals at respective points in the circuit shown in FIG. 1.

DESCRIPTION OF THE PREFERRED EMBODIMENT

For the sake of simplicity of explanation, the present invention is herein described with respect to an embodiment realized as a monophonic musical instrument.

A preferred embodiment of this invention, illustrated in FIG. 1, includes a key switch circuit 1 provided for a keyboard, not shown. The key switch circuit 1 has a plurality of key switches corresponding to respective keys of the keyboard. When a key is depressed, a key switch corresponding thereto operates to supply a logic signal "1" along its output line. The key switch circuit 1 contains a single note preference circuit which, when two or more key switches are simultaneously operated, produces a signal "1" on only an output line corresponding to a key switch having a highest priority. Furthermore, the key switch circuit 1 produces a key-on signal KON showing that either one of the keys is being depressed.

Output lines corresponding to respective key switches of the key switch circuit 1 are connected to respective inputs of a frequency number memory device 2 prestoring frequency numbers corresponding to the note pitches of respective keys (each value is determined proportional to the frequency). When a key is depressed, the frequency number memory device 2 is addressed by the output of the key switch circuit 1 to read out the frequency number R corresponding to the note pitch of the depressed key.

A clock oscillator 3 is also provided, which produces a clock pulse $t_c$ having a definite time period (e.g. one micro-second). The frequency of the clock pulse $t_c$ is divided W by, a counter 4, to produce a computation interval timing signal $t_x$. W represents the total number of the harmonics to be synthesized, and therefore $W=64$ where up to the 64th harmonic is to be synthesized. The computation interval timing signal $t_x$ formed in this manner is supplied to a gate circuit 5 which is enabled each time the computation interval timing signal $t_x$ is applied to supply the frequency number R output from the frequency number memory device 2 to a fundamental phase increment accumulator 6. Each time a frequency number R is supplied via the gate circuit 5 (that is, each time a computation interval timing signal $t_x$ arrives), the fundamental phase increment accumulator 6 accumulates the frequency number R and outputs an accumulated value qR which increases as 1R, 2R, 3R . . . . And when the accumulated value qR exceeds the modulo N (in this embodiment $N=2W$) of the fundamental phase increment accumulator 6, it overflows and continues a counting-up operation with the existing digit. Similarly, an accumulation operation is thereafter repeated each time the computation interval timing signal $t_x$ arrives. As described above, the accumulated value qR, which varies each time the computation interval timing signal $t_x$ arrives, is supplied to a harmonic phase increment accumulator 8 via a gate circuit 7 which is controlled by the clock pulse $t_c$. In this case, since the frequency of the clock pulse $t_c$ is W times that of the computation interval timing signal $t_x$, the gate circuit 7 is enabled W times during one period of the computation interval timing signal $t_x$. As a consequence, the harmonic phase increment accumulator 8 sequentially accumulates the accumulated value qR output from the gate circuit 7 at each arrival of the clock pulse $t_c$ so as to output an accumulated value nqR, where n increases a 1, 2, 3, . . . . When the harmonic phase increment accumulator 8 completes W times the accumulation, it is reset by the computation interval timing signal $t_x$ and thereafter repeats the same operation from 0. Consequently, during one period of the computation interval timing signal $t_x$ the accumulated value nqR (n=1, 2, 3 . . . W) which sequentially increases in accordance with the clock pulse $t_c$, is generated by the harmonic phase increment accumulator 8. The accumulated value nqR is decoded by a memory address decoder 9, into individual line outputs and the decoded output is supplied, to act as an address signal, to a sinusoid memory 10 which is storing sequential sampling point amplitude values of one period of a sinusoid waveform to read out logarithmically expressed sinusoid values, log sin ($\pi$/W) nqR, from the sinusoid memory 10.

As can be noted from the foregoing description, each of the accumulated values qR produced by the fundamental phase increment accumulator 6 represents each of the successive sampling points of the musical tone waveform amplitude to be calculated, while the accumulated value nqR produced by the harmonic phase increment accumulator 8 represents the phase of the nth harmonic at a sampling point qR now being calculated. Consequently, the sinusoid memory 10 sequentially produces the sine amplitude values, log sin ($\pi$/W) nqR (n=1, 2, 3 . . . W), of respective harmonics (including the fundamental wave) at a given sampling point qR in an order of the fundamental wave, the first harmonic, the second harmonic, the third harmonic . . . the Wth harmonic. In this case, the sampling point of the musical tone waveform to be calculated is sequentially shifted each time the computation interval timing signal $t_x$ arrives, but to which one the sampling point should be shifted next is determined by the frequency number R which is proportional to the pitch of the depressed key. Thus, the sinusoid memory 10 sequentially produces, on the time division basis, the sine amplitude values, log sin ($\pi$/W) nqR, of the respective harmonics corresponding to the note pitch of the depressed key.

The construction described above produces, on the time division basis, W harmonic components having the same peak amplitude. In this example, the total number of the harmonic components is 64.

A counter 11 is constituted by a counter of modulo W, and sequentially counts the number of the clock pulses $t_c$ in synchronism with the counter 4 and supplies its count to an amplitude coefficient memory 12 as an address signal n, where n progresses as 1, 2, 3 . . . W. The amplitude coefficient memory 12 stores a first set of amplitude coefficients, log $C_{n1}$ (where n=1, 2, 3 . . . W), for W harmonics determining a frequency spectrum configuration necessary to obtain a musical tone signal having a desired waveform, the first set of amplitude coefficients having previously been given from a parameter set circuit 13 as parameter data signals $D_1$ for the intended tone color. Accordingly, when supplied from the counter 11, an address signal n which sequentially varies in synchronism with the clock pulse $t_c$, amplitude coefficients log $C_{n1}$ that are stored at respective addresses and determine the amplitude values of respective harmonics, are sequentially read out from the amplitude coefficient memory 12, and the read out amplitude coefficients log $C_{n1}$ are supplied to an adder 14. This adder 14 multiplies the sine amplitude value, log sin ($\pi$/W) nqR, of each harmonic read out on the time division basis, from the sinusoid memory 10 at each sampling point with an amplitude coefficient log $C_{n1}$ set for each harmonic according to a logarithmic addition operation, and supplies the result of the calculation $F_n$=log $C_{n1}$ sin ($\pi/W$) nqR, to an adder 15. In this case, since the counter 11 operates synchronously with the harmonic phase increment accumulator 8, the amplitude coefficients log $C_{n1}$, sequentially read out for respective harmonics are separately multiplied with corresponding harmonic sine amplitude values log sin ($\pi$/W) nqR, thus setting amplitude values for respective harmonics. Thus, the adder 14 produces harmonic amplitude values defining a certain tone color, an example of which is shown in FIG. **2*b***.

The amplitude values log $C_{n1}$ sin ($\pi$/W) nqR, of respective harmonic components output from the adder 14, are supplied to another adder 15 and desired variation is imparted to the amplitude values by the cooperation of the adder 15, a time function generator 16, an amplitude coefficient memory 17 and a multiplier 18. Thus, the time function generator 16 produces, in synchronism with the building up of a key-on signal KON, an envelope waveform signal log $EV_1$ for varying with time the amplitude values of respective harmonic components in respective desired manners. The circuit is constructed such that the waveform of the signal log $EV_1$ can be controlled as desired by applying a parameter data signal $D_2$ to the time function generator 16 from the parameter set circuit 13. For this reason, by applying beforehand the parameter data signal $D_2$ to the time function generator 16 from the parameter set circuit 13, the time function signal log $EV_1$ having a waveform as shown in FIG. **2*c***, for example, can be generated in synchronism with the building up of the key-on signal KON. The time function signal log $EV_1$ represents the amount of attenuation along the ordinate. In this example, when all bits are "1", the signal log $EV_1$ represents the amount of attenuation of −96 dB (more minus means more attenuation here), whereas when all bits are "0" that of 0 dB.

Figure 2A:
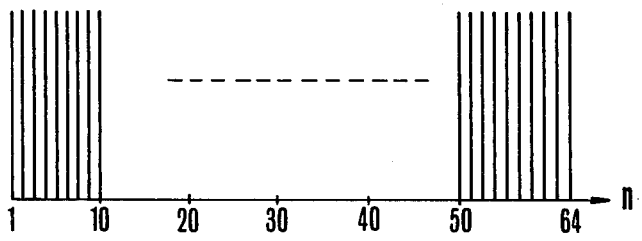
Figure 2B:
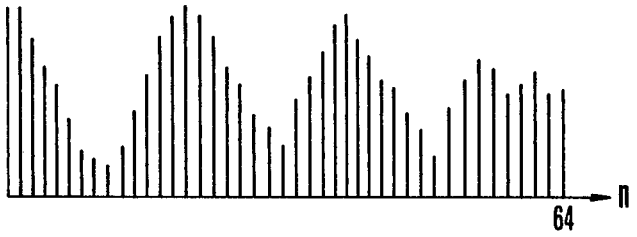
Figure 2C:
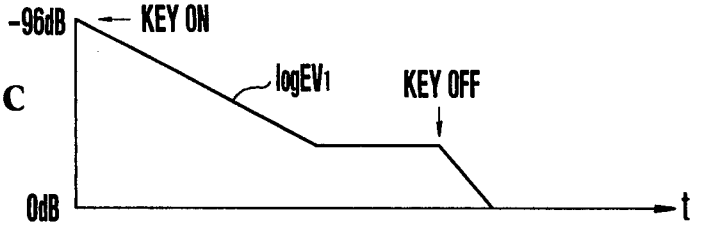
Figure 2D:
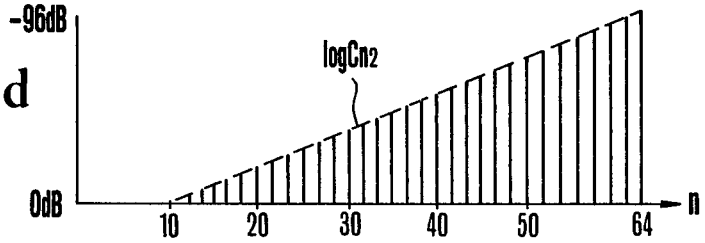
Figure 2E:
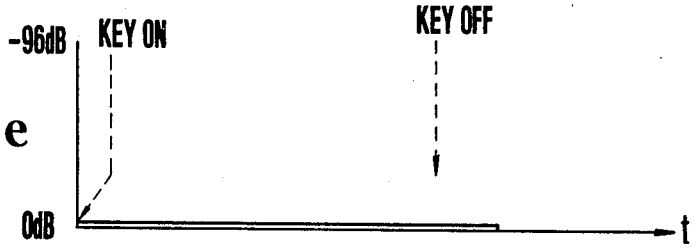
Figure 2F:
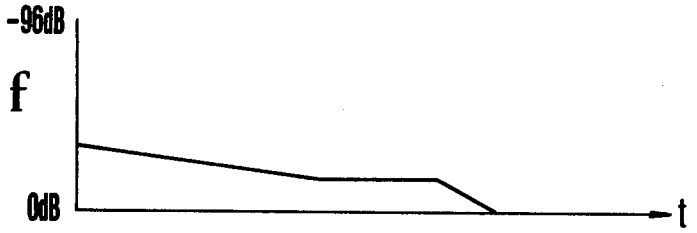
Figure 2G:
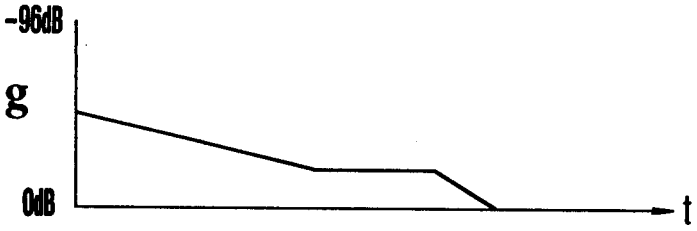
Figure 2H:
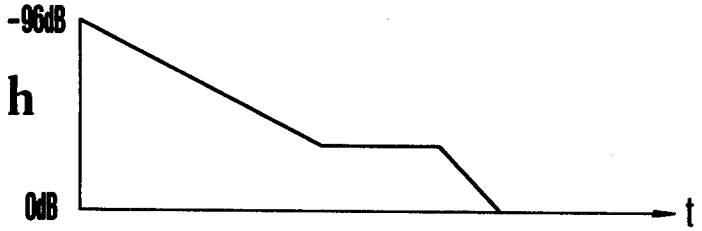

The amplitude coefficient memory 17 stores a second set of amplitude coefficients log $C_{n2}$ (where n=1, 2, 3 . . . W) for W harmonics as the second set of amplitude coefficients log $C_{n2}$ are supplied from the parameter set circuit 13 as the parameter data signals $D_2$ and, thereafter, the contents log $C_{n2}$ are read out by the address signal output from the counter 11. The amplitude coefficients log $C_{n2}$ output from the amplitude coefficient memory 17 control respective amounts of variation with time to be imparted to the respective corresponding harmonic components by the time function signal log $EV_1$ and have different values for respective harmonics, an example of which is shown in FIG. 2*d*. Similar to the signal log $EV_1$ this amplitude coefficient log $C_{n2}$ also represents the amount of attenuation of −96 dB when all bits are "1", whereas that of 0 dB when all bits are "0".

The time function signal log $EV_1$ and the amplitude coefficients log $C_{n2}$ thus produced are applied to the multiplier 18 to be multiplied with each other and the respective products [log $EV_1 \times$ log $C_{n2}$] are supplied to the adder 15 in a time division multiplexed manner to be multiplied with the amplitude values log $C_{n1}$ sin ($\pi$/W) nqR of respective harmonics according to a logarithmic addition operation. When the time function signal log $EV_1$ and the amplitude coefficients log $C_{n2}$ respectively produced by the time function generator 16 and the amplitude coefficient memory 17 have configurations as shown in FIG. 2*c* and FIG. 2*d*, then among the signals log $C_{n2}$.log $EV_1$ output from the multiplier 18, signals log $C_{12}$.log $V_1$; log $C_{102}$.log $EV_1$; log $C_{252}$.log $EV_1$ and log $C_{642}$.log $EV_1$ regarding the respective orders n=1, n=10, n=25 and n=64 are shown by FIGS. 2*e* through 2*h* respectively as examples. Consequently, in the adder 15 respective harmonic components are caused to vary differently with time. The degrees of variations with time can be controlled as desired according to the amplitude coefficients log $C_{n2}$, whereby the adder 15 produces amplitude values of the respective harmonics whose spectrum vary with time in a desired manner. Accordingly, a circuit including the adder 15, the time function generator 16, the amplitude coefficient memory 17 and the multiplier 18 acts as a controllable variable filter whose filter characteristics vary with time in accordance with the coefficient log $C_{n2}$ and the signal log $EV_1$.

The parameter set circuit 13, as mentioned above, produces parameter data $D_1$, $D_2$, $D_3$ and $D_4$. Each of the data $D_1$ and $D_3$ is manually selected from a plurality of sets of parameter data decisive of the amplitude coefficients, one of which has a combination pattern different from that of another by switching a manual selection switch 13*a*. In the same manner, each of the data $D_2$ and $D_4$ is manually selected from a plurality of sets of parameter data decisive of the shape of the time function, one of which has a combination pattern different from that of another.

Figure 2I:
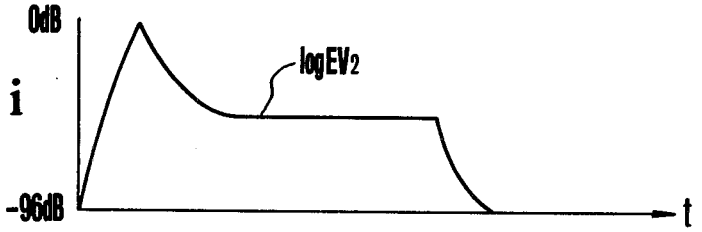

The amplitude values log $Fn = \log C_{n2}.\log EV_1 + \log (C_{n1}.\sin(\pi/W)\ nqR)$ of the respective harmonics imparted with time variations are imparted with a general envelope from the attack to the decay of a musical tone by an adder 19 according to a time function signal log $EV_2$ generated by a time function generator 20. The waveform of the time function signal log $EV_2$ can be controlled, as desired, by applying a parameter data $D_4$ to the time function generator 20 from the parameter set circuit 13. When a key-on signal KON is supplied to the time function generator 20 it generates a time function signal log $EV_2$ having a waveform, an example of which is shown in FIG. 2*i*.

In the adder 19, the respective harmonics are set in respective amplitudes to become amplitude values log $EV_2.F_n$, which in turn are converted into amplitude values $EV_2.F_n$ in terms of natural values by a logarithmic/linear converter (LOG/LIN CON) 21 and then supplied to an accumulator 22.

The accumulator 22 sequentially accumulates the amplitude values $EV_2.F_n$ of respective harmonics output from the logarithmic/linear converter 21 to sum up all the values for n=1 through n=W. Upon receipt of each computation interval timing signal $t_x$, a gate circuit 23 is enabled to supply the accumulated value (each representing an amplitude value at each of the successive sampling points of a musical tone waveform) output from the accumulator 22 to a D/A converter 24. At the same time, the accumulator 22 is reset to repeat, again, the accumulating operation described above for the purpose of calculating an amplitude value for the next successive sampling point. Consequently, the D/A converter 24 is supplied with a signal which has been obtained by varying with time the amplitude values (digital values) of a musical tone waveform (at its respective sampling points) having a period corresponding to the pitch of the depressed key and having a waveform set by the amplitude coefficients log $C_{n1}$ of the respective harmonics in accordance with the time function signal log $EV_1$ and the amplitude coefficients log $C_{n2}$ and further be imparted with the general envelope in accordance with the time function log $EV_2$, each time a computation interval timing signal $t_x$ is delivered. As described above, as the digital amplitude values are converted into analog signals and then supplied to a sound system 25, a musical tone having a pitch corresponding to the depressed key and having a tone color which varies with time, corresponding to the coefficients log $C_{n1}$ log $C_{n2}$ and to the signal log $EV_2$, is sounded with the volume variation (general envelope) in accordance with the variation with time of the signal log $EV_2$. More particularly, where the amplitude values of respective harmonics output from the adder 14 are as shown in FIG. 2*b*, and where the amplitude coefficients log $C_{n2}$ are as shown in FIG. 2*d*, then among the amplitude values of the respective harmonics up to the 64th order, the amplitude values of the harmonics lower than the 10th harmonic are applied to the adder 19 without being subjected to any limitation, whereas the amplitude values of the harmonics equal to or higher than the 10th harmonic are imparted with time variation by the signals log $EV_1$ in accordance with the coefficients log $C_{n2}$ and then input to the adder 19. As a consequence, the amplitude values of the respective harmonics output by the adder 14 are influenced (modified) by the adder 15 as if they were passed through a low pass filter having a cut-off frequency equal to the 10th harmonic. The amplitude values of the harmonics equal to and higher than the 10th harmonic are varied with time by the signal log $EV_1$ according to the coefficient log $C_{n2}$. Thus, according to the control provided by the coefficients log $C_{n2}$ and the signal log $EV_1$, the amplitude values of the respective harmonics are varied with time at high accuracies and in desired shapes, thus enabling the formation of numerous tone colors.

Although in the embodiment described above the variation with time of the spectrum of a harmonic component is controlled by a single time function generator 16, it is also possible to divide a plurality of harmonic components into separate groups and to control the time variations separately from one group to another.

While in the foregoing embodiment such data as the sine amplitudes and amplitude coefficients of the respective harmonic components are generated as logarithmic data and the multiplication of the data is performed with an adder, it is also possible to generate the data as the linear or natural data so as to multiply respective data by using a multiplier. Furthermore, the processing order of the multiplications (location order of the adders 14, 15 and 19) is not limited to that of the embodiment, but can be arbitrarily set. Moreover, the multiplier 18 [which multiplies the coefficients log $C_{n2}$ with the signal log $EV_1$, thus calculating a $(C_{n2}+EV1)$ (where a represents the base of logarithm)] can be substituted by any other calculator.

As can be noted from the foregoing description, according to this invention, the variation with time of the amplitudes of a plurality of harmonic components that constitute a musical tone can be controlled for respective harmonics so that it is easy to readily design the apparatus which can vary with time, the tone color of a musical tone with a compact construction and at a high accuracy, thus making it possible to produce a musical tone having numerous tone colors which has been impossible with a conventional musical synthesizer.

What is claimed is:

1. An electronic musical instrument comprising:

harmonics generating means for generating a plurality of original harmonic component signals for a predetermined number of harmonics;

amplitude coefficient generating means for generating a first set of amplitude coefficients and a second set of amplitude coefficients for each harmonic;

time function generating means for generating a first time function signal and a second time function signal, each of which varies with time in a predetermined manner;

first computing means for producing time varied amplitude coefficients for each harmonic by arithmetically combining each amplitude coefficient of said second set of amplitude coefficients with said first time function signal;

second computing means for producing respective time varied modified harmonic component signals for each harmonic by arithmetically combining each of said plurality of original harmonic component signals with the corresponding one of said first set of amplitude coefficients, the corresponding one of said time varied amplitude coefficients and said second time function signal; and synthesizing means for synthesizing said modified harmonic component signals, thereby producing a musical tone.

2. An electronic musical instrument according to claim 1 wherein said first computing means is of a logarithmic processing type.

3. An electronic musical instrument according to claim 1 wherein said first set of amplitude coefficients is one selected from a plurality of sets of amplitude coefficients, one of which has a combination pattern different from that of another.

4. An electronic musical instrument according to claim 1 wherein said second set of amplitude coefficients is one selected from a plurality of sets of amplitude coefficients one of which has a combination pattern different from that of another.

5. An electronic musical instrument according to claim 1 wherein said first time function signal is one selected from a plurality of time function signals, one of which has a time variation pattern different from that of another.

6. An electronic musical instrument according to claim 1 wherein said second time function signal is one selected from a plurality of time function signals, one of which has a time variation pattern different from that of another.

7. An electronic musical instrument according to claims 3, 4, 5 or 6, wherein said selecting operation is made through switching operation of a manual selection switch.

* * * * *